US007218199B1

(12) United States Patent
Chang

(10) Patent No.: US 7,218,199 B1
(45) Date of Patent: May 15, 2007

(54) STRUCTURE OF TRANSFORMER

(75) Inventor: Shih-Hsien Chang, Taoyuan Hsien (TW)

(73) Assignee: Delta Electronics, Inc., Taoyuan Hsien (TW)

( * ) Notice: Subject to any disclaimer, the term of this patent is extended or adjusted under 35 U.S.C. 154(b) by 0 days.

(21) Appl. No.: 11/456,413

(22) Filed: Jul. 10, 2006

(30) Foreign Application Priority Data

Apr. 17, 2006 (TW) ..... 95113698 A

(51) Int. Cl.
*H01F 27/24* (2006.01)

(52) U.S. Cl. ..... 336/212; 336/198

(58) Field of Classification Search ..... 336/212
See application file for complete search history.

(56) References Cited

U.S. PATENT DOCUMENTS 4,352,079 A * 9/1982 Mueller et al. ..... 336/65
6,611,190 B2 * 8/2003 Chui et al. ..... 336/198
7,091,817 B2 * 8/2006 Peck et al. ..... 336/208
2005/0073385 A1 * 4/2005 Wu et al. ..... 336/208

* cited by examiner

*Primary Examiner*—Elvin Enad
*Assistant Examiner*—Joselito S. Baisa

(57) ABSTRACT

A transformer includes a primary winding coil, a plurality of electrically-conductive sheets, a bobbin and a magnetic core assembly. The bobbin includes a first tube member, a second tube member and plural partition plates. The first tube member and the second tube member have a first channel and a second channel therein, respectively. Each partition plate is sheathed around the first tube member and the second tube member and includes a receptacle for accommodating respective electrically-conductive sheet, and the primary winding coil is wound around the second tube member.

20 Claims, 13 Drawing Sheets

STRUCTURE OF TRANSFORMER

FIELD OF THE INVENTION

The present invention relates to a structure of a transformer, and more particularly to a structure of a transformer having increased leakage inductance.

BACKGROUND OF THE INVENTION

A transformer has become an essential electronic component for various kinds of electric appliance. Referring to FIG. 1, a schematic exploded view of a conventional transformer is illustrated. The transformer 1 principally comprises a magnetic core assembly 11, a bobbin 12, a primary winding coil 13 and a secondary winding coil 14. The primary winding coil 13 and the secondary winding coil 14 are wounded around the bobbin 12. A tape 15 is provided for isolation and insulation. The middle portions 111 of the core 11 are embedded into the cylinder tube 121 of the bobbin 12. The primary winding coil 13 and the secondary winding coil 14 interact with the magnetic core assembly 11 to achieve the purpose of voltage regulation.

Since the leakage inductance of the transformer has an influence on the electric conversion efficiency of a power converter, it is very important to control leakage inductance. Related technologies were developed to increase coupling coefficient and reduce leakage inductance of the transformer so as to reduce power loss upon voltage regulation. In the transformer of FIG. 1, the primary winding coil 13 and the secondary winding coil 14 are superimposed with each other and wounded around the bobbin 12. As a consequence, there is less magnetic flux leakage generated from the primary winding coil 13 and the secondary winding coil 14. Under this circumstance, sine the coupling coefficient is increased, the leakage inductance of the transformer is reduced and the power loss upon voltage regulation is reduced, the electric conversion efficiency of a power converter is enhanced.

In the power supply system of the electric products in the new generation, for example LCD televisions, the transformer with leakage inductance prevails. The current generated from the power supply system will pass through a LC resonant circuit composed of an inductor L and a capacitor C. The inductor L is provided from the primary winding coil of the transformer. Meanwhile, the current with a near half-sine waveform will pass through a power MOSFET (Metal Oxide Semiconductor Field Effect Transistor) switch. When the current is zero, the power MOSFET switch is conducted. After a half-sine wave is past and the current returns zero, the switch is shut off. As known, this soft switch of the resonant circuit may reduce damage possibility of the switch and minimize the noise.

In order to increase the leakage inductance of the transformer, the primary winding coil should be separate from the secondary winding coil by a certain distance to reduce the coupling coefficient of the transformer. Referring to FIG. 2, a schematic exploded view of a transformer with leakage inductance according to prior art is illustrated. The transformer 2 principally comprises a bobbin 21, a primary winding coil 22, a secondary winding coil 23 and a tape 24. The bobbin 21 comprises a first side plate 211, a second side plate 212 and a winding member 213. The tape 24 is wound around the middle portion of the winding member 213 and has a width d. The winding member 213 is divided into a first winding section 2131 and a second winding section 2132, which are located at bilateral sides of the tape 24. The primary winding coil 22 and the secondary winding coil 23 are wound around the first winding section 2131 and the second winding section 2132, respectively. The first winding section 2131 is separated from the first side plate 211 by wrapping a first side tape 25 on the winding member 213 between the first winding section 2131 and the first side plate 211. Likewise, the second winding section 2132 is separated from the second side plate 212 by wrapping a second side tape 26 on the winding member 213 between the second winding section 2132 and the second side plate 212. For safety regulations, the tape 24 is used for isolation between the primary winding coil 22 and the secondary winding coil 23. Via the first side tape 25 and the second side tape 26, the primary winding coil 22 and the secondary winding coil 23 are electrically isolated from the conductors outside the transformer 2. As the width d of the tape 24 between the primary winding coil 22 and the secondary winding coil 23 is increased, the coupling coefficient is reduced and the leakage inductance of the transformer is increased. Under this circumstance, the resonant circuit of the power supply system will be conveniently controlled.

Although the transformer structure of FIG. 2 is advantageous for increasing the leakage inductance, some drawbacks still exist. As previously described, the magnitude of the leakage inductance is dependent on the width d of the tape 24 between the primary winding coil 22 and the secondary winding coil 23. Since the tape 24 is made of flexible material and fails to be firmly fixed, the structure of the transformer is readily distorted due to a long-term using period or serious vibration. Under this circumstance, the magnitude of the leakage inductance is reduced or unstable, and the resonant circuit of the power supply system will be adversely affected. Since these tapes are sticky and narrow in width, the procedures of wrapping the tape 24, the first side tape 25 and the second side tape 26 are labor-intensive and complicated. In addition, if the wrapping result is unsatisfied, the electrical performance of the transformer is impaired.

Since the tape 24, the first side tape 25 and the second side tape 26 are wrapped on the winding member 213 of the bobbin 21, the remaining area or volume for winding the primary winding coil 22 and the secondary winding coil 23 around the winding member 213 is limited and thus the heat-dissipating effect is usually insufficient. Furthermore, after the procedures of winding the coils and wrapping the tapes, a layer of insulating tape is additionally wrapped around the primary winding coil 22 and the secondary winding coil 23. The insulating tape also impairs heat dissipation of the transformer during operation. Moreover, since the melting point of the tape 24 is relatively lower, the operating temperature of the transformer is restricted by the melting point of the tape 24.

Furthermore, since the secondary winding coil of the conventional transformer is manually wound and fabricated, the labor cost is increased and the fabricating efficiency is reduced. The diameter of the secondary winding coil is too small to be used in high power application.

In views of the above-described disadvantages, the applicant keeps on carving unflaggingly to develop a structure of a transformer according to the present invention through wholehearted experience and research.

SUMMARY OF THE INVENTION

It is an object of the present invention to provide a structure of a transformer for effectively controlling and increasing leakage inductance, and enhancing electric safety.

It is another object of the present invention to provide a transformer, which is simple in the structure, easily assembled and cost-effective.

In accordance with an aspect of the present invention, there is provided a transformer. The transformer comprises a primary winding coil, a plurality of electrically-conductive sheets, a bobbin and a magnetic core assembly. The bobbin comprises a first tube member, a second tube member and plural partition plates. The first tube member and the second tube member have a first channel and a second channel therein, respectively. Each partition plate is sheathed around the first tube member and the second tube member and includes a receptacle for accommodating respective electrically-conductive sheet, and the primary winding coil is wound around the second tube member.

In accordance with another aspect of the present invention, there is provided a transformer. The transformer comprises a primary winding coil, a plurality of electrically-conductive sheets, a main body, a primary winding coil frame and a magnetic core assembly. The main body comprises a first surface, plural apertures, a first tube member, plural partition plates and a first receptacle. The first receptacle is next to the first surface, the first tube member has a first channel therein, and each partition plate is sheathed around the first tube member and includes a second receptacle for accommodating respective electrically-conductive sheet. The primary winding coil frame is accommodated within the first receptacle and including a second tube member. The second tube member has a second channel therein and a winding section for winding the primary winding coil thereon, and the second channel of the second tube member is communicated with corresponding apertures of the main body. The magnetic core assembly is partially embedded into the first channel of the first tube member, the apertures of the main body and the second channel of the second tube member.

The above contents of the present invention will become more readily apparent to those ordinarily skilled in the art after reviewing the following detailed description and accompanying drawings, in which:

BRIEF DESCRIPTION OF THE DRAWINGS

FIG. 3(*b*) is a cross-sectional view of FIG. 3(*a*) taken along the line A–A';

FIG. 3(*c*) is a schematic exploded view of the transformer according to the first preferred embodiment, in which the primary winding coil is wound around the second tube member;

FIG. 3(*d*) is a schematic assembled view of the transformer according to the first preferred embodiment;

FIG. 4(*b*) is a cross-sectional view of FIG. 4(*a*) taken along the line B–B';

FIG. 4(*c*) is a schematic exploded view of the transformer according to the second preferred embodiment, in which the primary winding coil is wound around the second tube member;

FIG. 4(*d*) is a schematic assembled view of the transformer according to the second preferred embodiment;

FIG. 5(*b*) is a schematic exploded view of the transformer according to the third preferred embodiment, in which the primary winding coil is wound around the second tube member; and FIG. 5(*c*) is a schematic assembled view of the transformer according to the third preferred embodiment.

DETAILED DESCRIPTION OF THE PREFERRED EMBODIMENT

Figure 1:
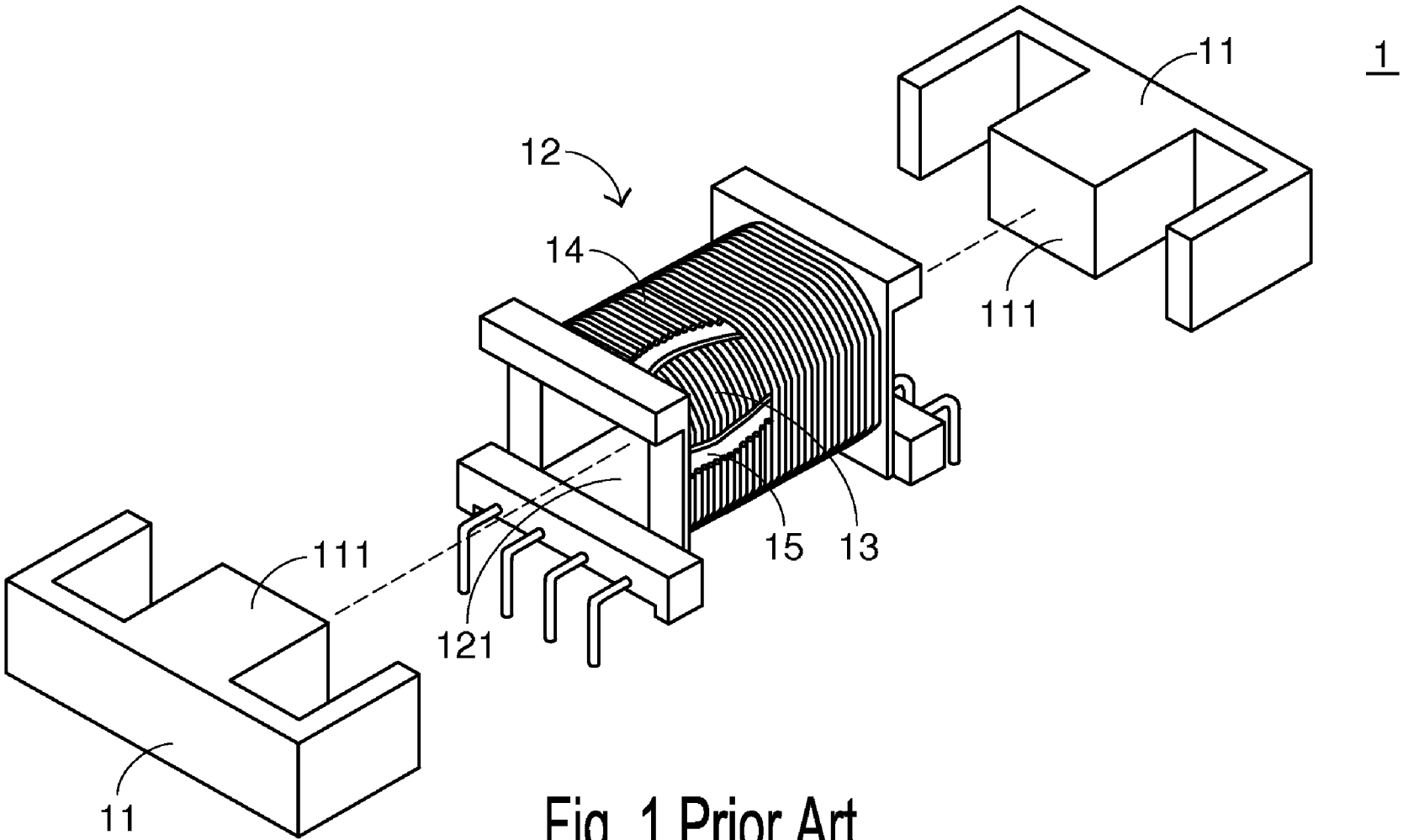
Fig. 1 Prior Art
FIG. 1 is a schematic exploded view of a conventional transformer.
Figure 2:
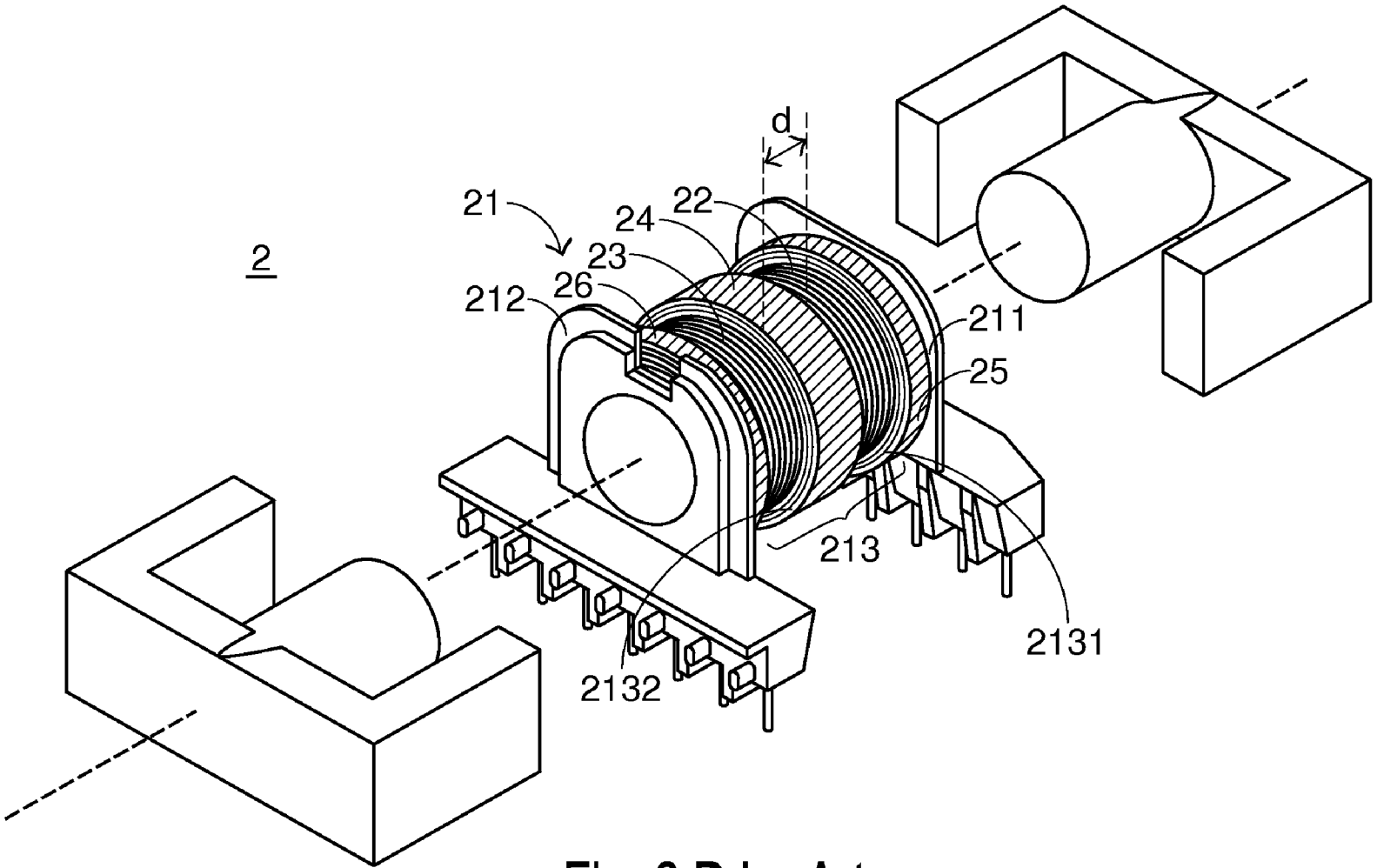
Fig. 2 Prior Art
FIG. 2 is a schematic exploded view of another conventional transformer with leakage inductance.
Figure 3A:
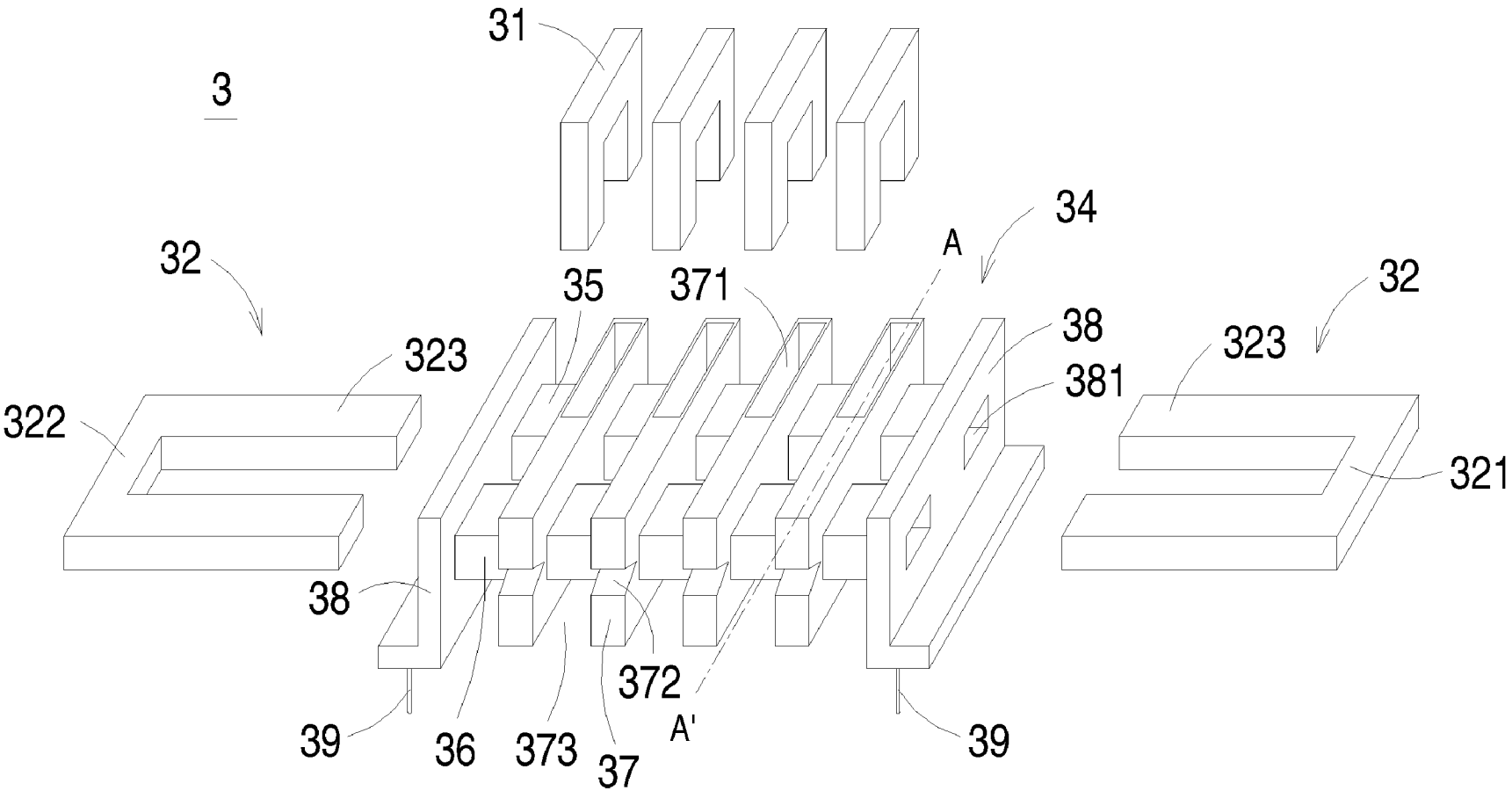
FIG. 3(*a*) is a schematic exploded view illustrating a transformer according to a first preferred embodiment of the present invention.
Figure 3B:
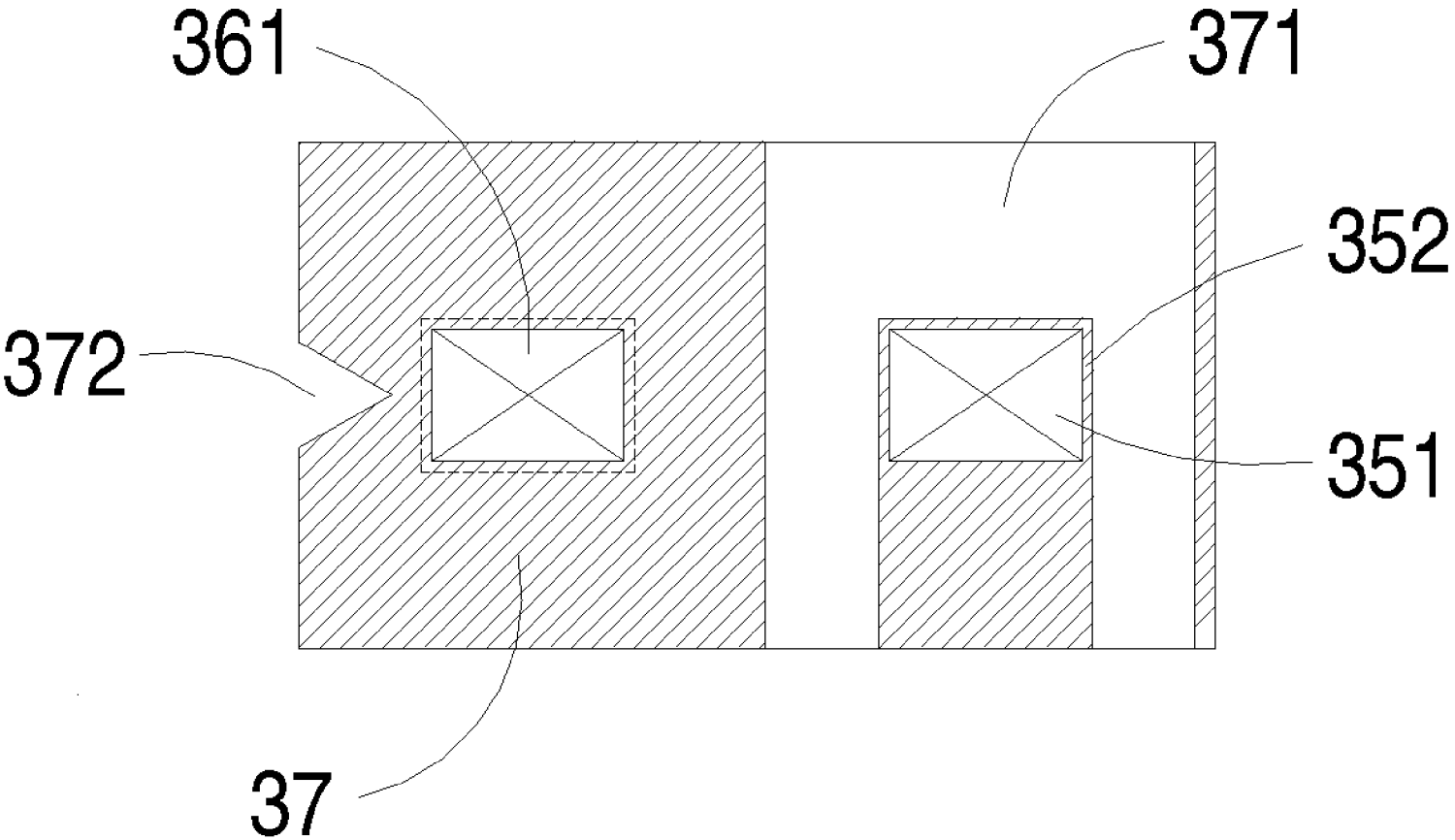
Figure 3C:
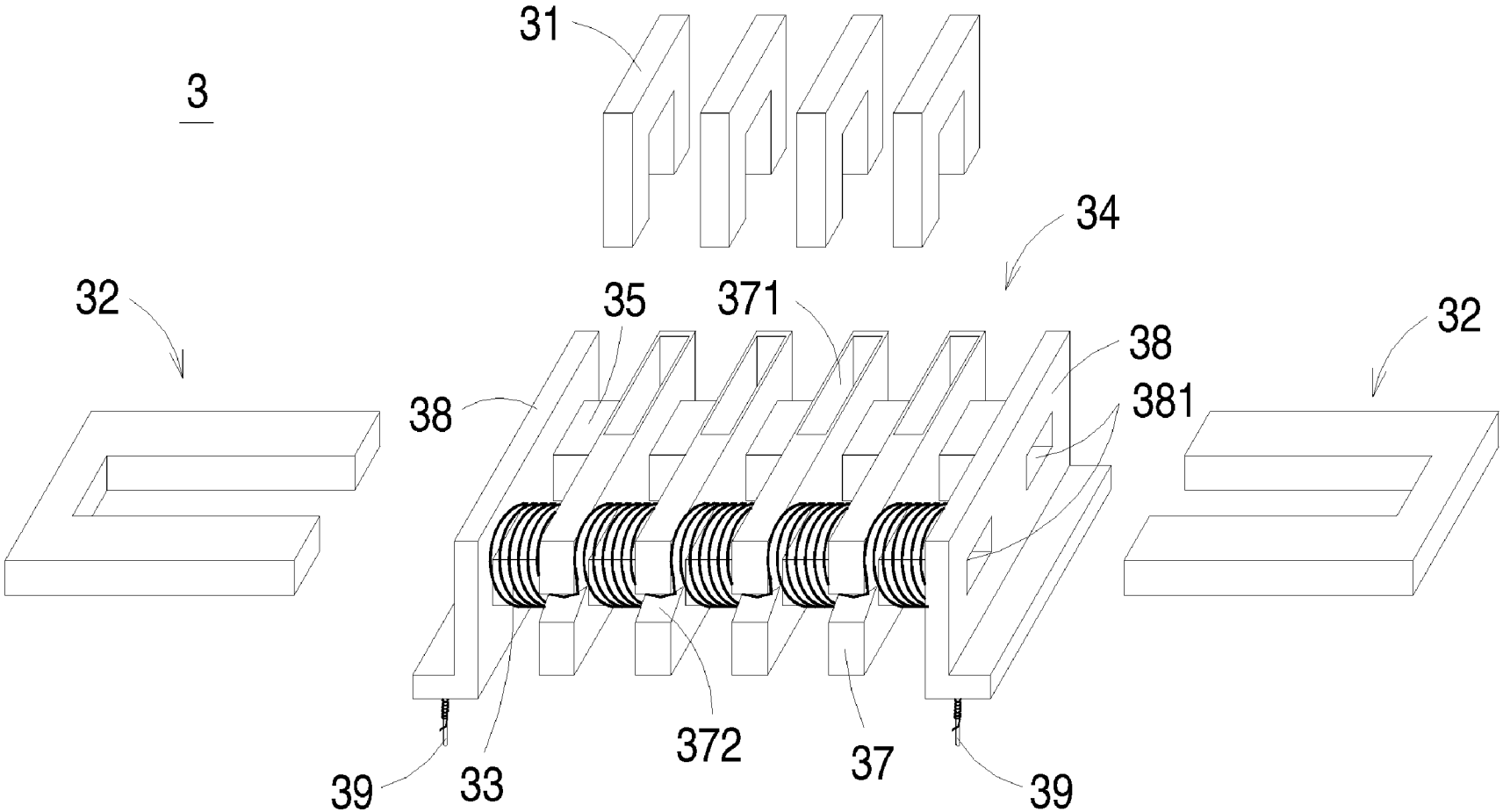
Figure 3D:
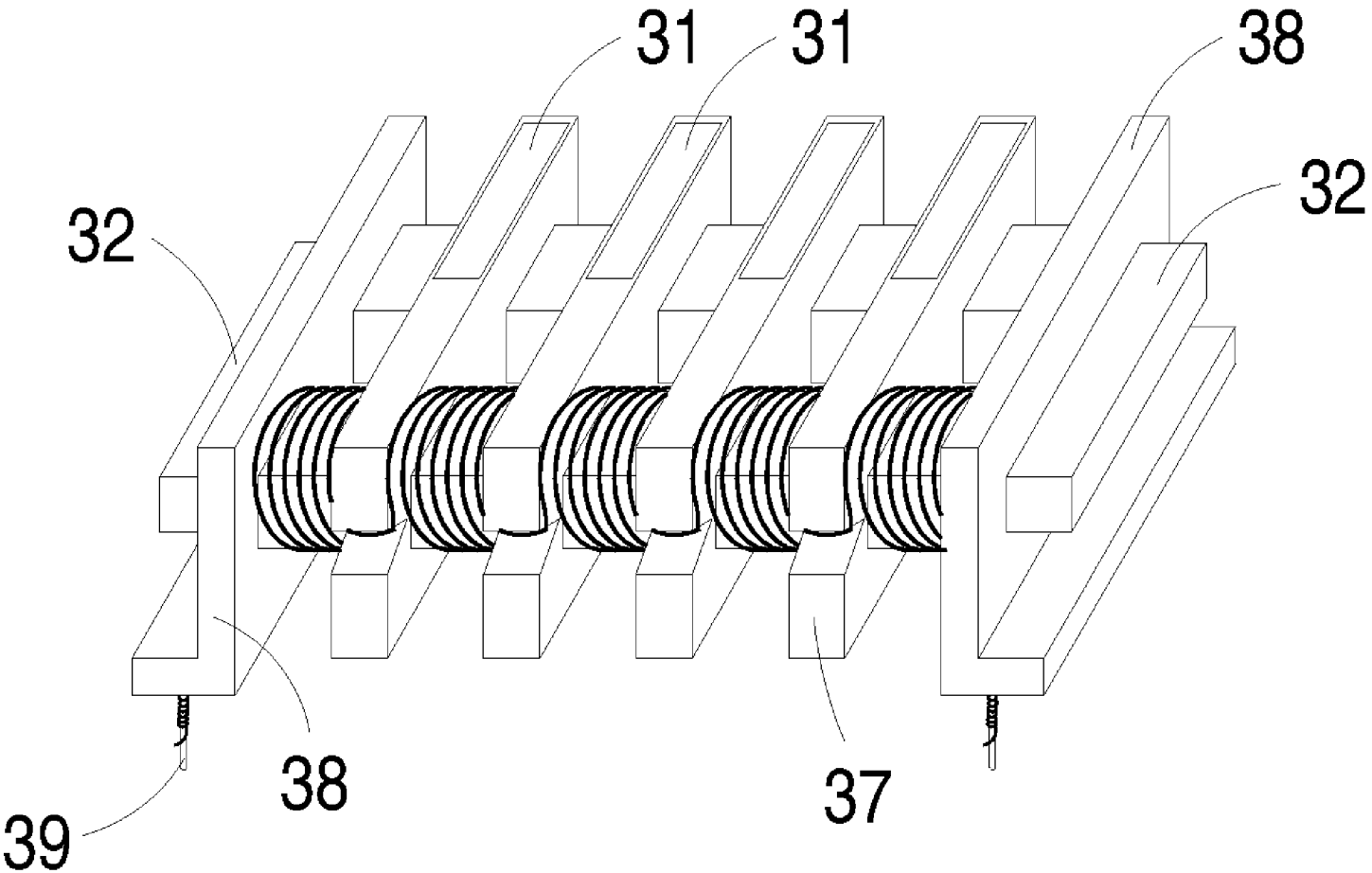
Figure 4A:
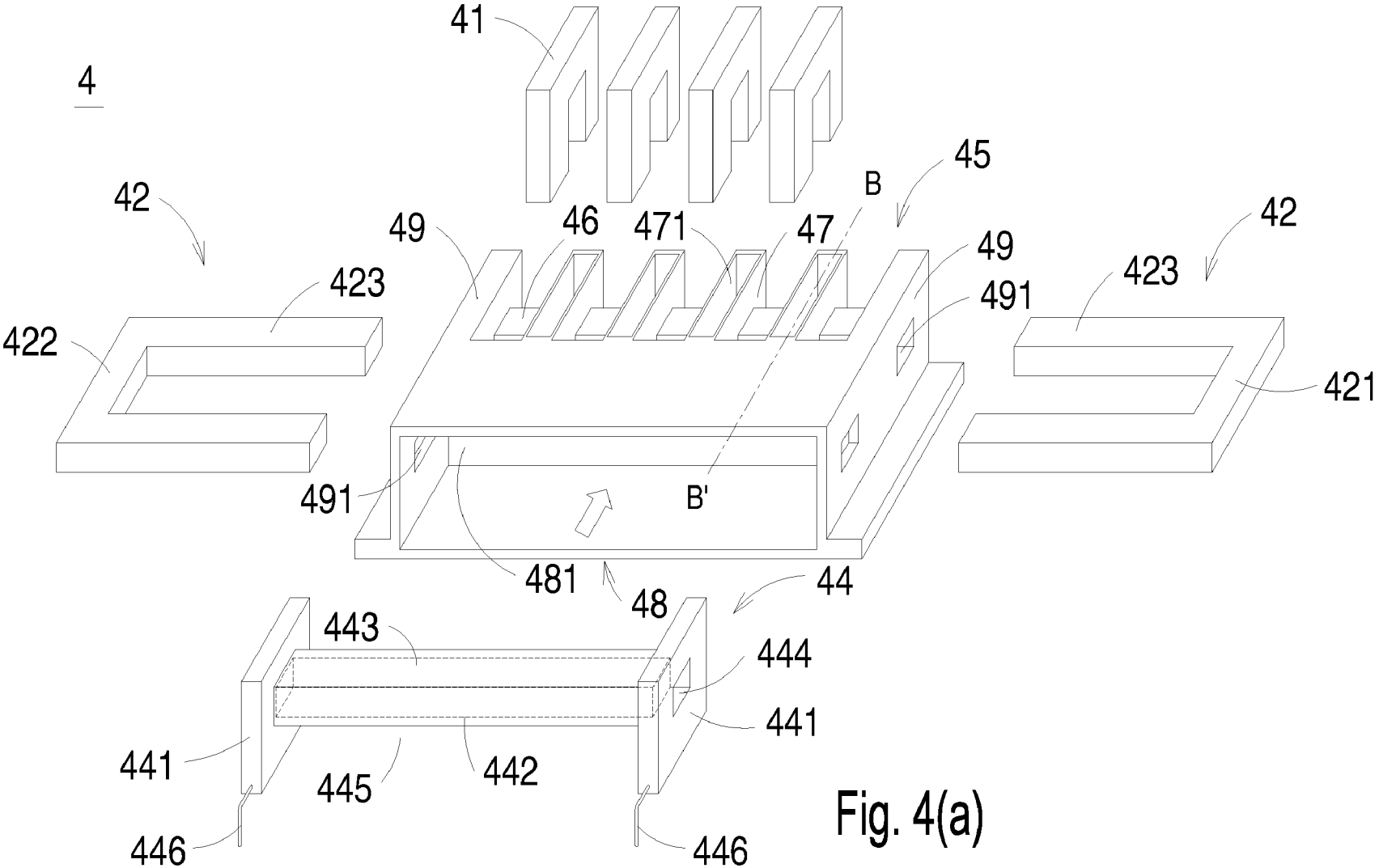
FIG. 4(*a*) is a schematic exploded view illustrating a transformer according to a second preferred embodiment of the present invention.
Figure 4B:
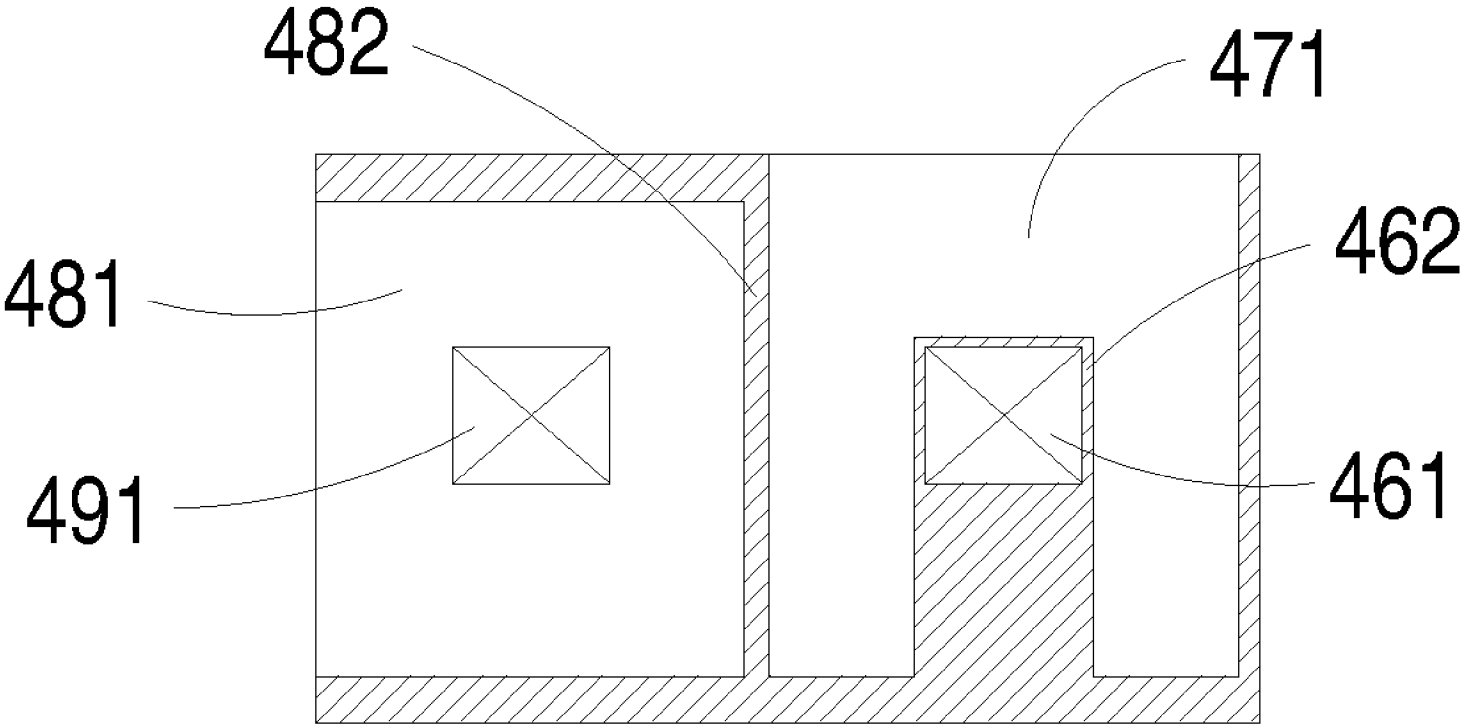
Figure 4C:
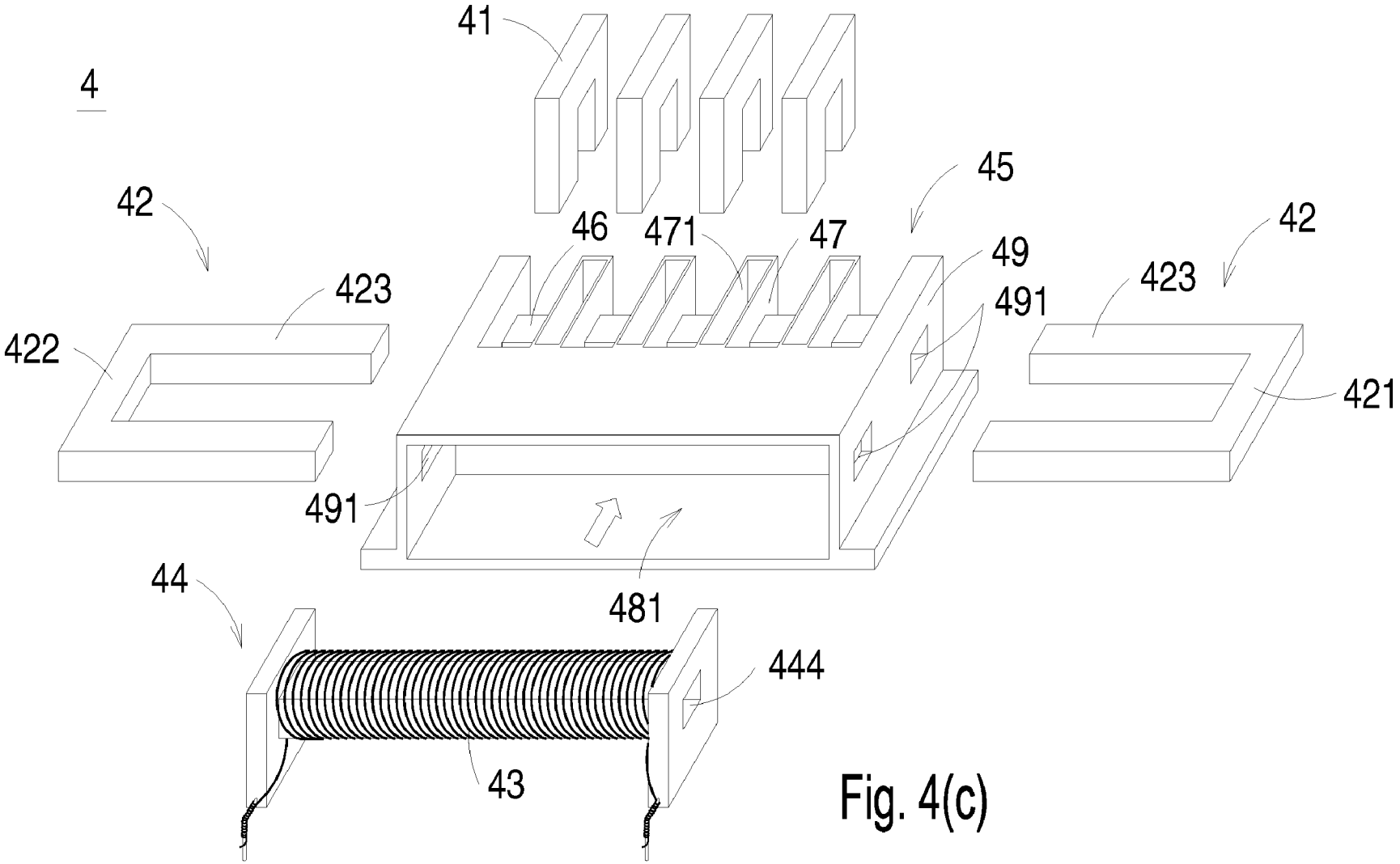
Figure 4D:
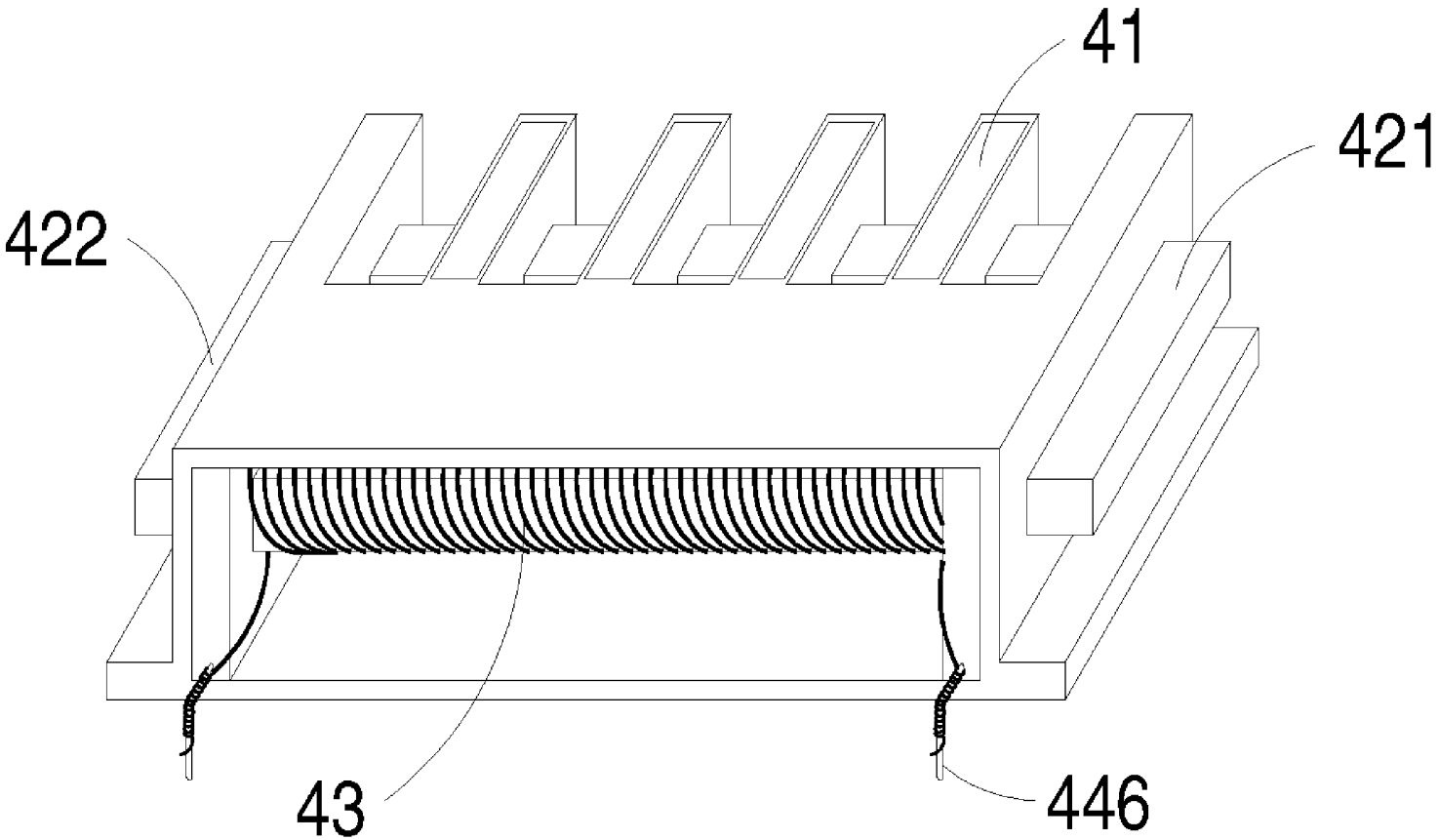

The present invention will now be described more specifically with reference to the following embodiments. It is to be noted that the following descriptions of preferred embodiments of this invention are presented herein for purpose of illustration and description only. It is not intended to be exhaustive or to be limited to the precise form disclosed.

Referring to FIGS. 3(*a*) and 3(*c*), schematic exploded views of a transformer according to a first preferred embodiment of the present invention is illustrated. The transformer 3 comprises a plurality of electrically-conductive sheets 31, a magnetic core assembly 32, a primary winding coil 33 (as shown in FIG. 3(*c*)) and a bobbin 34.

The bobbin 34 comprises a first tube member 35, a second tube member 36, plural partition plates 37, two side plates 38 and plural pins 39. The first tube member 35 and the second tube member 36 are arranged between and connected to these two side plates 38. The first tube member 35 and the second tube member 36 are substantially parallel with each other. Please also refer to FIG. 3(*b*). The first tube member 35 and the second tube member 36 have a first channel 351 and a second channel 361 therein, respectively.

In this embodiment, the plural partition plates 37 are all sheathed around the first tube member 35 and the second tube member 36. In addition, each partition plate 37 has a receptacle 371 corresponding to the first tube member 35 and is used for accommodating respective electrically-conductive sheet 31 therein, as is shown in FIG. 3(*d*). As also shown in FIG. 3(*b*), within the receptacle 371 of each partition plate 37, the channel 351 of the first tube member 35 is covered by a side wall 352. After the electrically-conductive sheet 31 is accommodated within the receptacle 371, the electrically-conductive sheet 31 is separated from the magnetic core assembly 32, which is embedded into the first channel 351.

Please refer to FIGS. 3(*a*) and 3(*c*). Since the plural partition plates 37 are sheathed around the first tube member 35 and the second tube member 36, a winding section 373 is defined between any two adjacent partition plates 37 for winding the primary winding coil 33 thereon. Furthermore, each partition plate 37 has a V-shaped notch 372 beside the second tube member 36. For winding the primary winding coil 33 on the bobbin 34, a terminal of the primary winding coil 33 is firstly soldered on a pin 39 under one of the side plates 38. The primary winding coil 33 is successively wound around the winding sections 373 from this side plate 38 to the opposite side plate 38 through the V-shaped notches 372. Afterward, the other terminal of the primary winding coil 33 is soldered onto the pin 39 on the opposite side plate 38.

In addition, these two side plates 38 have several apertures 381 in communication with the first channel 351 of the first tube member 35 and the second channel 361 of the second tube member 36.

The magnetic core assembly 32 of the transformer 3 includes a first magnetic part 321 and a second magnetic part 322, which are cooperatively formed as a UU-type core assembly or a UI-type core assembly. Take the UU-type core assembly for example. Each of the first magnetic part 321 and the second magnetic part 322 is a U-shaped magnetic core with two extension parts 323. The extension parts 323 of the first magnetic part 321 and the second magnetic part 322 are embedded into the first channel 351 of the first tube member 35 and the second channel 361 of the second tube member 36. Furthermore, the extension parts 323 of the first magnetic part 321 are in contact with the extension parts 323 of the second magnetic part 322. In the configuration as shown in FIG. 3(*d*), the primary winding coil 33 and the electrically-conductive sheets 31 interact with the magnetic core assembly 32 to achieve the purpose of voltage regulation and output the DC voltage via the external wires (not shown) connected to the electrically-conductive sheets 31.

In the above embodiment, the electrically-conductive sheets 31 are U-shaped and made of high conductive material such as copper. The electrically-conductive sheets 31 are accommodated within corresponding receptacles 371 of the partition plates 37 and stride over the side wall 352.

In the above embodiment, the transformer 3 of the present invention utilizes the electrically-conductive sheets 31 in replace of the conventional secondary winding coil. After the primary winding coil 33 is wound around the second tube member 36 and the electrically-conductive sheets 31 and the magnetic core assembly 32 are mounted onto the bobbin 34, the transformer 3 is finished in a simplified manner. Since the volume and the cross-section of the electrically-conductive sheet 31 are large, the output power of the transformer 3 is increased. As a consequence, the problem of causing low output power limited by the small diameter of the secondary winding coil in the prior art will be overcome. Furthermore, since the electrically-conductive sheets 31 are made of high conductive material and the partition plates 37 have receptacles 371, the overall heat-dissipating efficiency of the transformer 3 is enhanced.

Referring to FIG. 4(*a*), a schematic exploded view of a transformer according to a second preferred embodiment of the present invention is illustrated. The transformer 4 comprises a plurality of electrically-conductive sheets 41, a magnetic core assembly 42, a primary winding coil 43 (as shown in FIG. 4(*c*)), a primary winding coil frame 44 and a main body 45.

The main body 45 comprises a first tube member 46, plural partition plates 47, a first surface 48, a first receptacle 481 next to the first surface 48, two side plates 49 and plural apertures 491. The first tube member 46 is arranged between and connected to these two side plates 49. The first tube member 46 has a first channel 461 therein, as is shown in FIG. 4(*b*).

In this embodiment, the plural partition plates 47 are sheathed around the first tube member 46. In addition, each partition plate 47 has a second receptacle 471 for accommodating respective electrically-conductive sheet 41 therein, as is shown in FIG. 4(*d*). As also shown in FIG. 4(*b*), within the second receptacle 471 of each partition plate 47, the first channel 461 of the first tube member 46 is covered by a first side wall 462. After the electrically-conductive sheets 41 are accommodated within the second receptacles 471, the electrically-conductive sheets 41 are separated from the magnetic core assembly 42, which is embedded into the first channel 461. In addition, the first receptacle 481 also has a second side wall 482 adjacent to the first surface 48 and the second receptacle 471. By the second side wall 482, the primary winding coil 43 which is wound around the primary winding coil frame 44 is separated from the electrically-conductive sheets 41 accommodated within the second receptacles 471.

In addition, these two side plates 49 of the main body 45 have several apertures 491 in communication with the first channel 461 of the first tube member 46 and the first receptacle 481.

Please refer to FIGS. 4(*a*) and 4(*c*). The primary winding coil frame 44 is accommodated within the first receptacle 481 of the main body 45, and comprises two side plates 441, a second tube member 442 and several pins 446 under the side plates 441. The second tube member 442 is arranged between and connected to these two side plates 441. The second tube member 442 has a second channel 443 therein and a winding section 445 for winding the primary winding coil 43 thereon. Each side plate 441 has an aperture 444 in communication with the second channel 443 of the second tube member 442. For winding the primary winding coil 43 on the second tube member 442 of the primary winding coil frame 44, a terminal of the primary winding coil 43 is firstly soldered on a pin 446 under one of the side plates 441. The primary winding coil 43 is successively wound around the winding section 445 from this side plate 441 to the opposite side plate 441. Afterward, the other terminal of the primary winding coil 43 is soldered onto the pin 446 on the opposite side plate 441.

The magnetic core assembly 42 of the transformer 4 includes a first magnetic part 421 and a second magnetic part 422, which are cooperatively formed as a UU-type core assembly or a UI-type core assembly. Take the UU-type core assembly for example. Each of the first magnetic part 421 and the second magnetic part 422 is a U-shaped magnetic core with two extension parts 423. The extension parts 423 of the first magnetic part 421 and the second magnetic part 422 are embedded into the first channel 461 of the first tube member 46, the apertures 491 of the main body 45, the apertures 444 of the primary winding coil frame 44 and the second channel 443 of the second tube member 442. Furthermore, the extension parts 423 of the first magnetic part 421 are in contact with the extension parts 423 of the second magnetic part 422. In the configuration as shown in FIG. 4(*d*), the primary winding coil 43 and the electrically-conductive sheets 41 interact with the magnetic core assembly 42 to achieve the purpose of voltage regulation and output the DC voltage via the external wires (not shown) connected to the electrically-conductive sheets 41.

In the above embodiment, the electrically-conductive sheets 41 are U-shaped and made of high conductive material such as copper. The electrically-conductive sheets 41 are accommodated within corresponding second receptacles 471 of the partition plates 47 and stride over the first side wall 452.

Figure 5A:
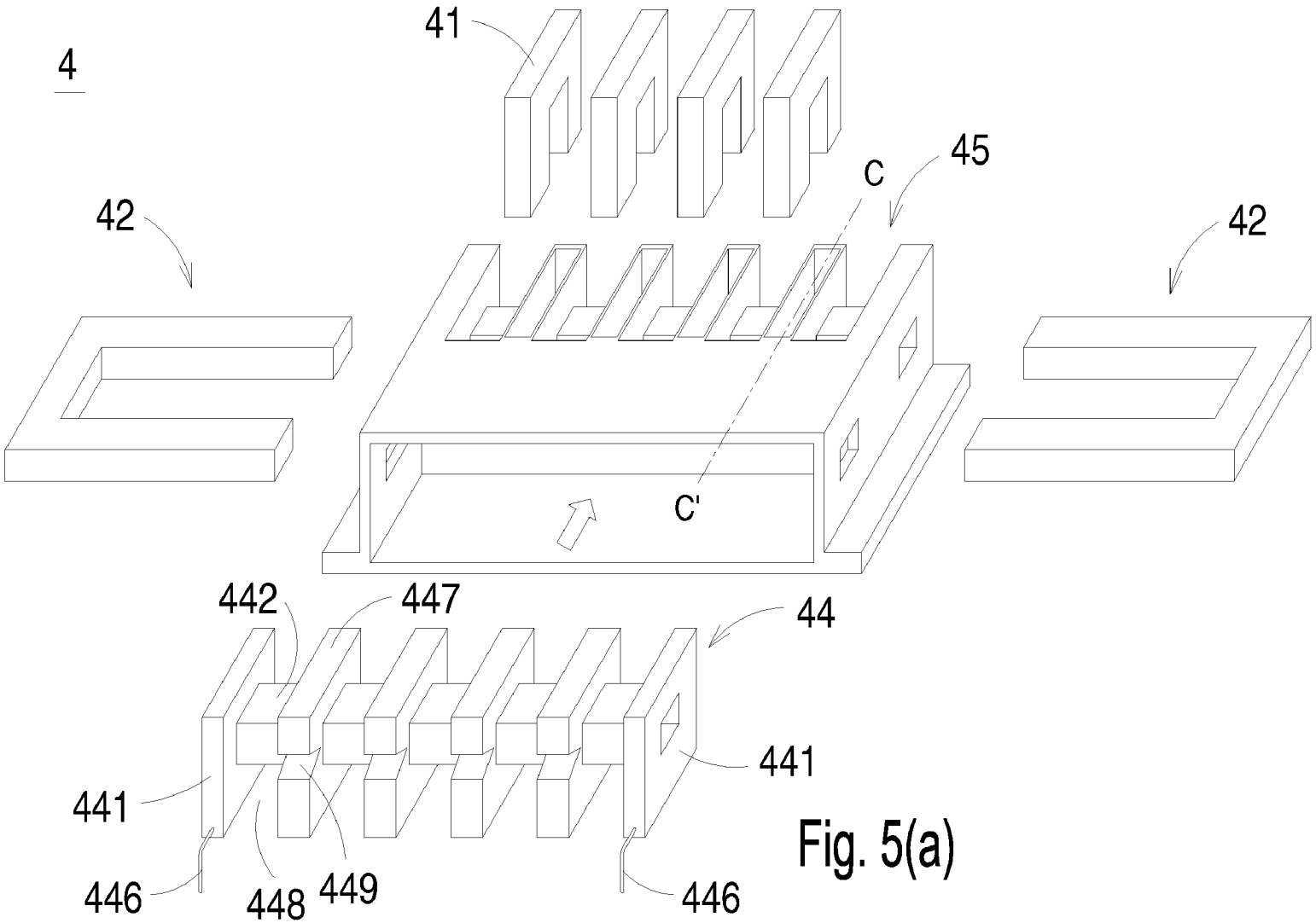
FIG. 5(*a*) is a schematic exploded view illustrating a transformer according to a third preferred embodiment of the present invention.
Figure 5B:
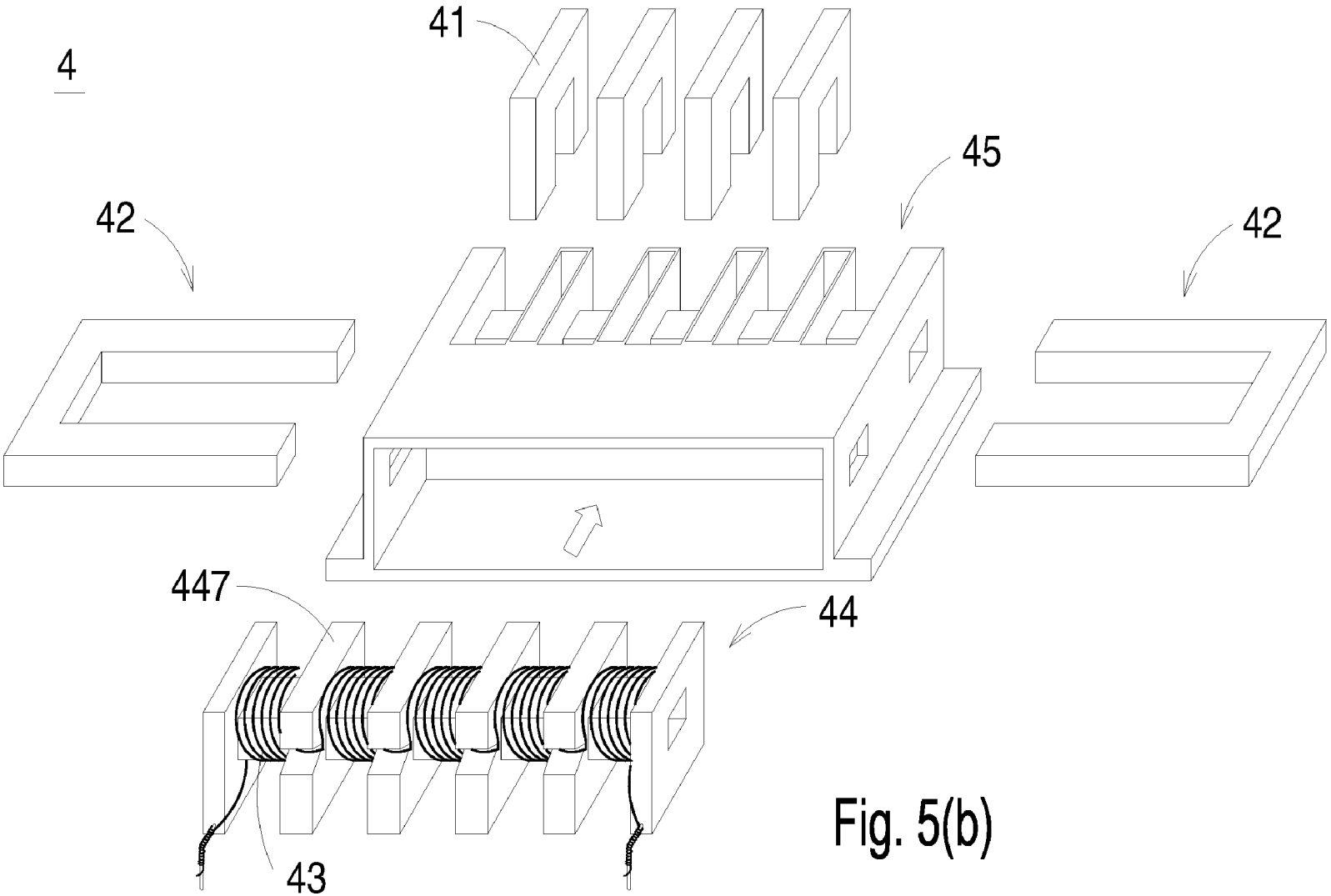
Figure 5C:
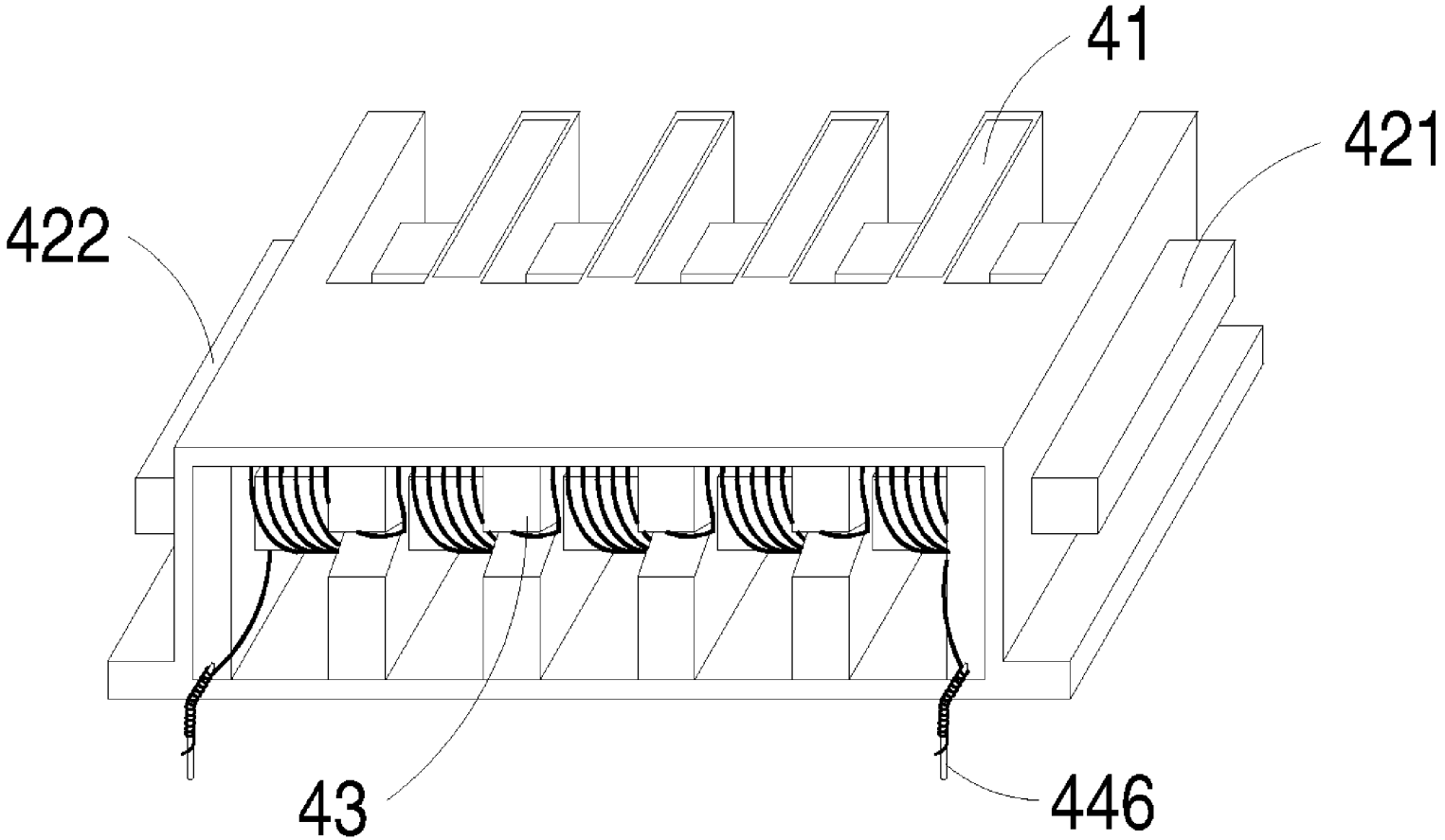

Referring to FIG. 5(*a*), a schematic exploded view of a transformer according to a third preferred embodiment of the present invention is illustrated. The transformer 4 also comprises a plurality of electrically-conductive sheets 41, a magnetic core assembly 42, a primary winding coil 43 (as shown in FIG. 5(*b*)), a primary winding coil frame 44 and a main body 45. The electrically-conductive sheets 41, the magnetic core assembly 42 and the main body 45 included therein are similar to those shown in FIG. 4(*a*), and are not redundantly described herein.

In this embodiment, between the side plates 441, the primary winding coil frame 44 further comprises plural partition plates 447, which are sheathed around the second tube member 442. As a consequence, a winding section 448 is defined between any two adjacent partition plates 447 for winding the primary winding coil 43 thereon. Furthermore, each partition plate 447 has a V-shaped notch 449. Please refer to FIG. 5(*b*), for winding the primary winding coil 43 on the second tube member 442 of the primary winding coil frame 44, a terminal of the primary winding coil 43 is firstly soldered on a pin 446 under one of the side plates 441. The primary winding coil 43 is successively wound around the winding sections 448 from this side plate 441 to the opposite side plate 441 through the V-shaped notches 449. Afterward, the other terminal of the primary winding coil 43 is soldered onto the pin 446 on the opposite side plate 441.

The process for assembling the transformer 4 is identical to that described in the second embodiment, and is not redundantly described herein. The assembled structure of the transformer 4 is illustrated with reference to FIG. 5(*c*).

In the above embodiments, the transformer 4 of the present invention utilizes the electrically-conductive sheets 41 in replace of the conventional secondary winding coil. After the primary winding coil 43 is wound around the second tube member 442, the primary winding coil frame 44 is accommodated within the first receptacle 481, and the electrically-conductive sheets 41 and the magnetic core assembly 42 are mounted onto the main body 45, the transformer 4 is finished in a simplified manner. Since the volume and the cross-section of the electrically-conductive sheet 41 are large, the output power of the transformer 4 is increased. As a consequence, the problem of causing low output power limited by the small diameter of the secondary winding coil in the prior art will be overcome. Furthermore, since the electrically-conductive sheets 41 are made of high conductive material and the partition plates 47 have second receptacles 471, the overall heat-dissipating efficiency of the transformer 4 is enhanced.

From the above description, by using the electrically-conductive sheets to replace the conventional secondary winding coil, the process of fabricating the transformer is simplified, the electric conversion efficiency is enhanced and the heat-dissipating efficiency is increased. In addition, since the electrically-conductive sheets are accommodated within the receptacles of the partition plates and/or the primary winding coil frame is accommodated within the receptacle of the main body, the distance between the primary winding coil and the electrically-conductive sheets is increased, the coupling coefficient is reduced, the leakage inductance of the transformer is increased and the electric safety is enhanced.

While the invention has been described in terms of what is presently considered to be the most practical and preferred embodiments, it is to be understood that the invention needs not be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. A transformer comprising:

a primary winding coil;

a plurality of electrically-conductive sheets;

a bobbin comprising a first tube member, a second tube member and plural partition plates, said first tube member and said second tube member having a first channel and a second channel therein, respectively, wherein each partition plate is sheathed around said first tube member and said second tube member and includes a receptacle for accommodating respective electrically-conductive sheet, and said primary winding coil is wound around said second tube member; and a magnetic core assembly partially embedded into said first channel of said first tube member and said second channel of said second tube member.

2. The transformer according to claim 1 wherein said magnetic core assembly is generally shaped as a UU-type core assembly or a UI-type core assembly, and includes a first magnetic part and a second magnetic part.

3. The transformer according to claim 2 wherein each of the first magnetic part and said second magnetic part has two extension parts embedded into said first channel of said first tube member and said second channel of said second tube member.

4. The transformer according to claim 1 wherein said electrically-conductive sheets accommodated within said receptacles are separated from said magnetic core assembly by a side wall of said first channel.

5. The transformer according to claim 4 wherein each electrically-conductive sheet is U-shaped copper sheet and strides over said side wall.

6. The transformer according to claim 1 wherein said first tube member and said second tube member of said bobbin are substantially parallel with each other.

7. The transformer according to claim 1 wherein said bobbin further comprises two side plates at bilateral sides thereof and connected to said first tube member and said second tube member.

8. The transformer according to claim 7 wherein said two side plates have several apertures in communication with said first channel of said first tube member and said second channel of said second tube member.

9. The transformer according to claim 7 wherein a winding section is defined between any two adjacent partition plates for winding said primary winding coil thereon.

10. The transformer according to claim 9 wherein each partition plate has a notch such that said primary winding coil is successively wound around said winding section through said notch.

11. A transformer comprising:

a primary winding coil;

a plurality of electrically-conductive sheets;

a main body comprising a first surface, plural apertures, a first tube member, plural partition plates and a first receptacle, wherein said first receptacle is next to said first surface, said first tube member has a first channel therein, and each partition plate is sheathed around said first tube member and includes a second receptacle for accommodating respective electrically-conductive sheet;

a primary winding coil frame accommodated within said first receptacle and including a second tube member, wherein said second tube member has a second channel therein and a winding section for winding said primary winding coil thereon, and said second channel of said second tube member is communicated with corresponding apertures of said main body; and a magnetic core assembly partially embedded into said first channel of said first tube member, said apertures of said main body and said second channel of said second tube member.

12. The transformer according to claim 11 wherein said magnetic core assembly is generally shaped as a UU-type core assembly or a UI-type core assembly, and includes a first magnetic part and a second magnetic part.

13. The transformer according to claim 12 wherein each of the first magnetic part and said second magnetic part has two extension parts embedded into said first channel of said first tube member and said second channel of said second tube member.

14. The transformer according to claim 11 wherein said primary winding coil frame comprises two side plates at bilateral sides thereof and connected to said second tube member, and said second tube member has a winding section between said two side plates for winding said primary winding coil thereon.

15. The transformer according to claim 14 wherein each of said side plates has an aperture in communication with said second channel of said second tube member.

16. The transformer according to claim 11 wherein said primary winding coil frame comprises two side plates at bilateral sides thereof and connected to said second tube member and plural partition plates between said two side plates, and a winding section is defined between any two adjacent partition plates for winding said primary winding coil thereon.

17. The transformer according to claim 16 wherein each of said side plates has an aperture in communication with said second channel of said second tube member.

18. The transformer according to claim 17 wherein each partition plate has a notch such that said primary winding coil is successively wound around said winding section through said notch.

19. The transformer according to claim 11 wherein said electrically-conductive sheets accommodated within said second receptacles are separated from said magnetic core assembly by a first side wall of said first channel, and said primary winding coil is separated from said electrically-conductive sheets by a second side wall of said first receptacle.

20. The transformer according to claim 19 wherein each electrically-conductive sheet is U-shaped copper sheet and strides over said first side wall.

* * * * *